United States Patent [19]

Rowe et al.

[11] Patent Number: 4,595,857

[45] Date of Patent: Jun. 17, 1986

[54] TENSION MASK COLOR CATHODE RAY TUBE APPARATUS

[75] Inventors: William A. Rowe, Palatine; Paul Strauss, Chicago, both of Ill.

[73] Assignee: Zenith Electronics Corporation, Glenview, Ill.

[21] Appl. No.: 572,089

[22] Filed: Jan. 18, 1984

[51] Int. Cl.[4] ..... H01J 29/82; H01J 29/81

[52] U.S. Cl. ..... 313/407; 220/2.1 A; 313/477 R

[58] Field of Search ..... 313/402, 407, 408, 477 R; 445/36, 47; 220/2.1 A

[56] References Cited

U.S. PATENT DOCUMENTS

| | | | |
|---|---|---|---|
| 2,961,560 | 11/1960 | Fyler | 313/408 X |
| 3,440,469 | 4/1969 | Bradu et al. | 313/89 |
| 3,894,321 | 7/1975 | Moore | 313/402 |

*Primary Examiner*—Palmer C. DeMeo

*Assistant Examiner*—Sandra L. O'Shea

*Attorney, Agent, or Firm*—Cornelius J. O'Connor; John H. Coult

[57] ABSTRACT

A color cathode ray tube includes a faceplate having a predetermined pattern of phosphor deposits on a target surface thereof and a rear envelope section. A color selection electrode assembly includes a frame supporting in tension a foil having a pattern of apertures related to the predetermined pattern of phosphor deposits. Means are provided for bonding the color selection electrode assembly between the faceplate and the rear envelope section with the pattern of foil apertures in registration with said pattern of phosphor deposits such that the color selection electrode assembly is incorporated as an integral part of the cathode ray tube envelope. The foil is sized and the frame adapted such that the foil is supported completely within the tube enclosure on a peripheral frame surface facing away from the said faceplate.

12 Claims, 3 Drawing Figures

TENSION MASK COLOR CATHODE RAY TUBE APPARATUS

CROSS-REFERENCE TO RELATED APPLICATIONS

This application is related to but in no way dependent upon copending applications Ser. Nos. 538,001 and 538,003 both filed Sept. 30, 1983; Ser. No. 572,088 filed Jan. 18, 1984; and Ser. Nos. 646,861 and 646,862, both filed Aug. 31, 1984, all of common ownership herewith.

BACKGROUND OF THE INVENTION

This invention relates in general to color cathode ray tubes, and to a novel color selection electrode arrangement for use in such a tube, which arrangement utilizes a tensed shadow mask.

In general, a color selection electrode or "shadow mask" is a device which is disposed adjacent the luminescent phosphor screen that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas by those beams. The choice of a color selection electrode for use in color television cathode ray tubes is, by and large, a choice between a spherical or biradial electrode and a cylindrical electrode tensed upon a heavy spring frame--both types being supported within the tube envelope. The most common type of color selection electrode used in color television receivers today is the conventional curved type.

In color picture tubes utilizing a conventional shadow mask, there is a tendency on the part of the mask to "dome" (localized buckling) in those areas where a scene characterized by very high brightness is depicted. For example, in a scene where a high concentration of light is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", a conventional mask cannot accommodate the power density that a "domingresistant" tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bi-metallic support springs; however, such provision can not resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color television manufacturer. In that tube, the color selection electrode comprises a grid formed of a multitude of parallel conductors tensed across a spring frame suspended conventionally within the tube.

This grid serves to mask the writing beams in such a fashion that they fall upon the desired light emitting phosphor.

In the afore-mentioned cylindrical faceplate tube, the mask supporting frame is mechanically stressed, as by compressing it, prior to attaching the shadow mask thereto. Upon release of the compression force, restoration forces in the frame establish tension in the mask.

An advantage of utilizing a tensed mask resides in the fact that the mask, while under tension, will not "dome". The mask retains its desired configuration during normal operating conditions.

Under extreme tube operating conditions, however, electron bombardment of a tensed grid mask can cause a series of grids of the mask to relax and cause color impurities. A cathode ray tube utilizing a tensed mask of the type adverted to above, the Sony Trinitron, is described in U.S. Pat. No. 3,638,063.

The color television cathode ray tube in most common usage today employs a faceplate which approximates a section of a large radius sphere. The shadow mask in such a tube, of course, is contoured to match the faceplate. A trend today is toward a flatter faceplate which, in turn, calls for a flatter shadow mask.

However, a flat mask is inherently less mechanically stable than a curved mask. Accordingly, to acquire stability, resort is had to a thicker mask, for example, one having a thickness in the order of 10 to 12 mils. This is approximately twice the thickness of a conventional curved mask. However, when one goes to a 10 to 12 mil mask the aperture etching process is much more difficult. Specifically, in order to prevent aperture limiting of the beam at the outer reaches of the mask, as would be encountered in a 90 degree tube, the apertures have to be etched at an angle to the plane of the mask, rather than etched substantially perpendicular to that plane as is the case for a conventional curved mask.

DISCUSSION OF OTHER PRIOR ART

An early example of a tensed shadow mask for use in a color television cathode ray tube is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 3,284,655—Oess is concerned with a direct viewing storage cathode ray tube employing a mesh storage target which is supported in a plane perpendicular to the axis of the tube. The mesh target comprises a storage surface capable of retaining a charge pattern which, in turn, control the passage therethrough of a stream of electrons. From a structural standpoint, it is proposed that the mesh storage screen be affixed (no details given) to a circumferential ring that is disposed across the open end of envelope member. One end of the ring is in contact with the edge of the envelope member which has a coating of glass frit applied thereon. The end wall of another envelope member, also coated with frit, is placed in contact with the other side of the ring so that the end walls of the envelope members now abut both sides of the ring. Thereafter this assembly is frit sealed to secure the ring and mesh target within the tube.

It is of particular significance that the electrode spanning the inside of the tube envelope is a mesh screen that is not said to be subject to tension forces. Moreover, the mesh screen is not a color selection electrode that serves to direct a writing beam to selected elemental areas of color phosphors. Finally, there is no criticality, perceived or discussed, as respects mesh target registration with the phosphor layer on the faceplate.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially disclosed but simply textually referred to, an arrangement is proposed comprising a glass donut-shaped structure into which the grid wires are sealed. This donut assembly is then inserted between the faceplate of the tube and its conical section. Thereafter, the patent notes, after the tube is assembled, the phosphors may be deposited on the faceplate by conventional photographic processes. The application of elemental color phosphor areas to the faceplate of a tube is, in itself, a formidable task; how this could be achieved with a grid structure in situ across the faceplate is dismissed perfunctorily.

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In one embodiment, the front panel is shown as having an inner ledge forming a continuous path around the tube, the top surface of which is a Q-distance away from the faceplate for receiving the foil mask such that the mask is sealed within the tube envelope. In another embodiment, an inner ledge is shown extending from the funnel for receiving the mask. An embodiment is also shown in which the faceplate is skirtless and essentially flat.

The following patents are also noted: No. 1,163,495(GB); U.S. Pat. Nos. 2,761,990; 3,440,469; 3,638,063; 3,873,874; 3,894,321; 4,069,567; and 4,495,473.

Other examples of the prior art practice of utilizing a tensioned grid-type structure in a cathode ray tube environment are described in the following U.S. Pat. Nos. 2,842,696, 2,905,845, 3,489,966, and 3,719,848.

On the other hand, a color cathode ray tube employing a planar tensed foil type shadow mask is described and claimed in referent co-pending application Ser. No. 538,003 filed Sept. 30, 1983 in the name of Kazimir Palac. Additionally, a color cathode ray tube employing a planar foil type mask in conjuntion with a flat faceplate is described and claimed in co-pending application Ser. No. 538,001, also filed on Sept. 30, 1983 in the name of Kazimir Palac.

Finally, and by way of emphasizing the extent to which the invention to be described departs from the prior art, attention is directed to U.S. Pat. No. 3,898,508 which shows and describes a faceplate and shadow mask (untensed) assembly representative of current practice.

OBJECTS OF THE INVENTION

Accordingly, it is a general object of the invention to provide an improved color selection electrode arrangement for use in a color cathode ray tube.

It is also an object of the invention to provide an improved color selection electrode arrangement utilizing an improved tension mask mount.

It is still another object of the invention to provide a tensed color selection electrode arrangement which is readily photoscreened.

DESCRIPTION OF A PREFERRED EMBODIMENT

Figure 1:
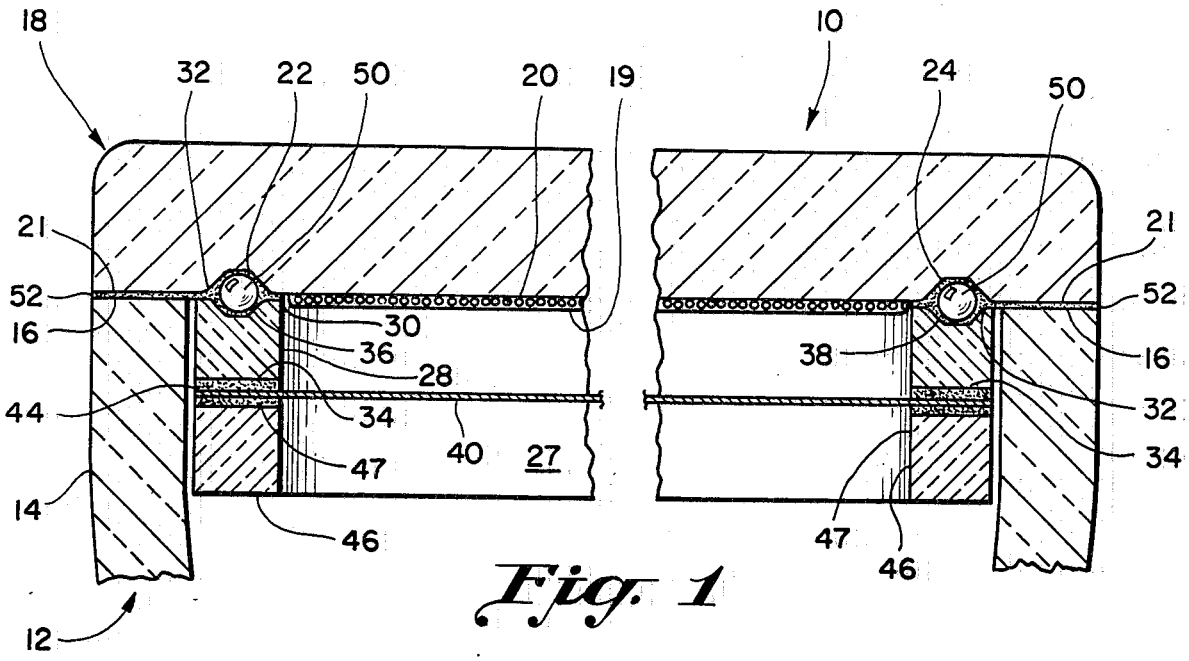
FIG. 1 is a sectioned view of a portion of a color cathode ray tube embodying the invention.

A color cathode ray tube 10, constructed in accordance with a preferred embodiment of the invention and shown in FIG. 1, comprises a funnel 12 (only partially illustrated) having a central axis and including a bell portion 14. The depicted extremity of bell portion 14 has a predetermined wall thickness and it comprises a sealing land 16.

More particularly, tube 10 comprises a flat, substantially rectangular, glass face panel 18 formed of a material having a predetermined temperature coefficient of expansion. Panel 18 comprises a target area 20 having a patterned screen 19 of luminescent primary color elemental phosphor deposits thereon, which deposits may be arranged in triads of red, green, and blue phosphor dots. A sealing land 21 circumscribes target area 20.

To facilitate its role in screen forming, face panel 18 is provided with registration affording means comprising means defining a first plurality of cavities 22, 24, in a preferred execution they constitute three holes of predetermined depth with each presenting an oval entrance that affords each cavity an elongated portion, so that, effectively, each cavity is provided with a foreshortened V-sided runway. This registration affording means, as well as an associated indexing means, is fully described and claimed in copending application Ser.

No. 572,088, filed concurrently herewith in the name of Paul Strauss.

The cavities are formed at selected locations upon the target side of panel 18, specifically on or near sealing land 21. As discussed in the Strauss application, it is of particular significance that the elongated portion of each cavity be aligned along a radial extending from the geometric center of panel 18 and that the cavities do not extend completely across sealing land 21 to the "outside".

A color selection electrode arrangement 27 that affords selective excitation of the phosphor deposits by a scanning beam of electrons comprises a substantially rectangular ring-like frame 28 (since panel 18 is rectangular) defining a central opening 30 dimensioned to enclose target area 20 of panel 18. Frame 28, which adopts the format of a section of a rectangular cylinder, is formed of a material having a temperature coefficient of expansion approximating that of panel 18, for example, glass or a ceramic of compatible coefficient of expansion. Frame 28 comprises first and second substantially flat, spaced apart, parallel surfaces, 32, 34, respectively. As will be seen, surfaces 32 and 34 ultimately serve as sealing lands, with surface 32 disposed in a confronting relation to face panel sealing land 21. Frame 28 also includes registration affording means comprising means defining a second like plurality of cavities 36, 38, formed at selected locations on surface 32 of the frame. Cavities 36, 38 while of a predetermined different depth than that of cavities 22, 24 adopt a similar profile in that each of the former likewise presents an oval entrance constituting an elongated portion aligned along a radial extending from the geometric center of frame 28.

Surface 34, on the other hand, comprises a shadow mask mounting surface which is characterized by an overall external span which is less than the span of face panel 18 by at least the wall thickness of funnel bell portion 14. The significance of this dimensioning is intended to insure that no part of the mask will be exposed to the "outside", since in operation, tube 10 will maintain a 20 KV to 30 KV voltage on the mask. By relegating the peripheral portion of the mask to a location within the confines of the funnel, the safety objective is attained.

Arrangement 27 further comprises a color selection electrode, or shadow mask, in the form of a tensed planar foil 40 which has a predetermined pattern of apertures which can be triads of minute circular holes, which pattern, of course, corresponds to the pattern of screen 19 on face panel 18. Foil 40 has a temperature coefficient of expansion which is greater than that of frame 28. Thus, foil 40 can be formed from cold rolled steel which is utilizable with a glass or ceramic frame. The peripheral portion of foil 40 is bonded to frame surface 34 by a bead of frit 44, a devitrifying glass adhesive employed in fabricating cathode ray tubes. As will be seen, frit 44 has a second role as a bonding agent. The manner in which a foil can be tensed and frit bonded to a glass or ceramic frame is fully described in referent co-pending patent application, Ser. No. 538,001, filed Sept. 30, 1983 in the name of Kazimir Palac.

In order to neutralize the application of any bending or flexing moment to frame 28, attributable to the tension forces in foil 40, arrangement 27 comprises a centrally apertured stabilizing, or stiffening, member 46, in the form of a rectangular ring (assuming, of course, that frame 28 and face panel 18 are rectangular). Ring 46 has a predetermined axial thickness and is formed of a material having a temperature coefficient of expansion compatible with that of frame 28. Ring 46 comprises a flat end face 47, which is bonded to the frame, and has an overall span such that it does not extend beyond the foil bonding surface 34 of frame 28. Preferably, at the same time the peripheral portion of foil 40 is bonded to surface 34, stabilizing ring 46 is bonded to that surface and by the same application of frit 44 so that foil 40 is sandwiched therebetween.

As can be appreciated, a precise and repeatable kinematic registration between foil frame 28 and face panel 18 is essential in order to utilize foil 40 as a stencil in screening the pattern of elemental phosphor deposits upon target surface 20 of the panel. Accordingly, to accomplish the aforesaid kinematic registration, there is provided indexing means comprising a plurality of spherical elements 50 individually receivable between an assigned one of the panel cavities and an adjacent, oppositely disposed confronting one of the frame cavities. More particularly, elements 50 comprise balls formed of an alloy composition, the coefficient of expansion of which is compatible with the envelope glass since they will ultimately be frit sealed, in situ, when tube 10 is assembled. A glass sealable metal alloy suitable for this purpose is available from Carpenter Technology Corporation in Reading, Pa. under their designation 430TI. Insofar as dimensional specifications are concerned, each of balls 50 desirably exhibits a sphericity of $\pm 0.000050$ inches. Additionally, because the cavities are of elongated configuration, each ball is afforded limited radial freedom along the confronting V-sided runways of its assigned panel and frame cavity to urge and establish a precise, repeatable registration between foil 40 and target area 20 of panel 18. Additionally, the ball diameter is such as to establish a predetermined Q spacing between target area 20 and foil 40. The manner in which the aforesaid repeatable registration is realized is fully developed in the above-mentioned copending Strauss application.

As noted, the result of the ball and cavity cooperation is to effect a repeatable registration, as between panel target area 20 and foil 40, to facilitate screening the face panel. Prior to the actual screening operation, electrode arrangement 27 is prepared as a tensed foil subassembly comprising frame 28 with foil 40 and ring 46 bonded thereto. As noted above, the tensing of a foil and its frit bonding to a frame is extensively treated in the referenced copending Palac application.

In the final assembly of cathode ray tube 10, sealing land 21 of panel 18 is bonded to frame surface 32 and is also bonded to funnel sealing land 16. The particular bonding agent is not critical, however, it is comtemplated that, in each instance, resort may be had to a bead of frit 52. As in the case with the frit bead 44 employed to bond foil 40 to frame 28, frit bead 52 can also constitute a devitrifying glass adhesive of the type commonly employed in fabricating cathode ray tubes. In each instance, the frit to be employed can be a low temperature solder glass material which is available from Owens-Illinois, Inc. under their designation CV-130.

Figure 2:
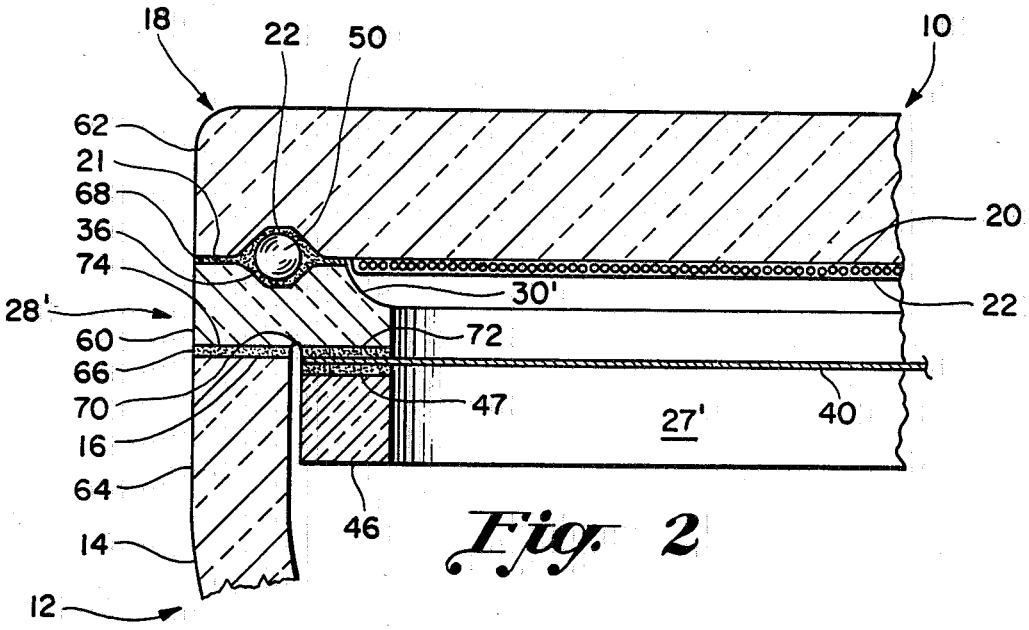
FIG. 2 is a fragmented sectioned view of a color cathode ray tube utilizing an alternate embodiment of the invention.

FIG. 2 illustrates an alternate embodiment of the invention, which is specifically addressed to the construction adopted by the color selection electrode arrangement 27. Sine the cathode ray tube 10 shown in FIG. 2 is, except for arrangement 27', the same as that illustrated in FIG. 1, like reference numerals are employed to identify like elements. Electrode arrangement 27' differs from its counterpart in FIG. 1 principally in its lateral dimension. As shown in FIG. 2, the outwardly facing wall 60 of frame 28' essentially coincides with the outer side wall 62 of face panel 18 as well as with the outside wall 64 of funnel bell portion 14. Frame 28' which is formed of the same material as its counterpart in FIG. 1, also comprises first and second substantially flat spaced-apart parallel surfaces 66, 68. Surface 66 comprises a groove 70 that extends completely around that surface to divide that surface into an inner, or foil mounting, area 72 and an outer sealing land area 74. Inner area 72, which serves to receive the peripheral portion of foil 40, is also the surface to which end face 47 of stabilizing ring 46 is bonded. The outer, or sealing land, area 74 of frame 28' serves to receive sealing land 16 of funnel bell portion 14.

Since it is contemplated that frame 28', foil 40 and stabilizing ring 46 will be fabricated as a subassembly during the foil tensioning process, it can now be appreciated that a function of groove 70 is to isolate the sealing land area 74 of surface 66 from surface 72 during the foil tensioning process which, of course, involves area 72, foil 40 and ring 46. As a result, a clean, readily workable area 74 is preserved for the subsequent frit sealing operation that bonds funnel sealing land 16 to that area.

Moreover, in this regard, the plane of foil mounting area 72 need not coincide with the plane of sealing land area 74. Specifically, and with reference to FIG. 3 wherein an alternate construction for the foil mounting frame is depicted, the frame 28" shown therein exhibits the same basic configuration as frame 28' except to the extent that the foil mounting area of frame 28" is positively isolated from its sealing land area by virtue of a shouldered, or pedestal construction. More particularly, frame 28" which defines a central opening 30 dimensioned to enclose target area 20 of foil 18, also comprises first and second substantially flat spacedapart parallel surfaces 66', 68'. Again, a groove 70' extends around one surface of frame 28" to divide surface 66' into an inner foil mounting area 72' and an outer sealing land area 74'. Inner area 72' which serves to receive the peripheral portion of foil 40, is also the surface to which end face 47 of stabilizing ring 46 is bonded. The outer area 74' serves, of course, to receive the sealing land 16 of the funnel.

In this alternate construction of frame 28" the plane of area 72' (and, of course, foil 40) is "below" (as one views FIG. 3) sealing land surface 74'. Additionally, the shoulder construction for frame 28" would materially ease practicing the above mentioned Palac process for tensing a foil and bonding it to its frame by affording a positive and definite isolation of area 72' from area 74'. Moreover, it should be appreciated that the differences in elevation as between areas 72' and 74' is not indicative of scale. In practice, the difference in elevation is small, the depicted illustration is intentionally exaggerated to distinguish from the FIG. 2 embodiment.

Figure 3:
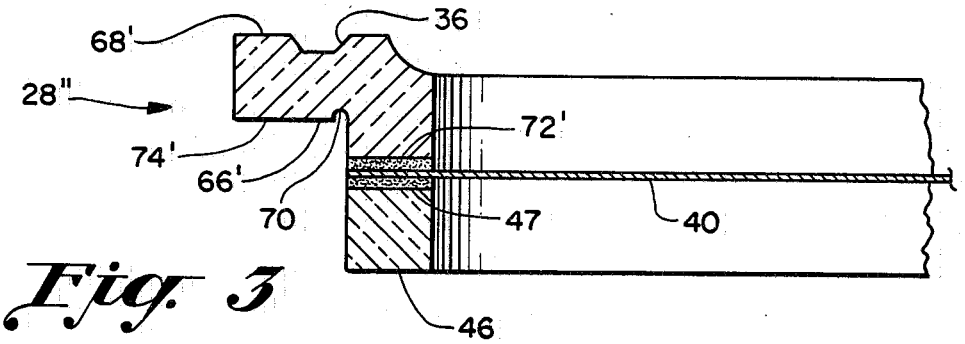
FIG. 3 is a sectional view of an alternate construction of an aspect of the invention.

In all other respects, that is insofar as materials are concerned, the alternate embodiments of FIGS. 2 and 3 are substantially similar to that of the principal embodiment of FIG. 1.

While particular embodiments of the invention have been shown and described, it will be obvious to those skilled in the art that changes and modifications may be made without departing from the invention in its broader aspects, and, therefore, the aim of the appended claims is to cover all such changes and modifications as fall within the true spirit and scope of the invention.

We claim:

1. A color cathode ray tube comprising:

an envelope funnel having a central axis and including a bell portion, one extremity of which has a predetermined wall thickness, said extremity further comprising a sealing land;

a face panel comprising a part of the CRT envelope and having a target surface with a pattern of luminescent primary color elemental phosphor areas deposited thereon and a sealing land circumscribing said target surface, said face panel having registration affording means selectively located and oriented thereon;

a color selection electrode assembly permitting selective excitation of said phosphor areas by a scanning beam of electrons comprising;

a tensed foil having a predetermined pattern of apertures, an insulating frame defining a central opening dimensioned to enclose said target surface of said face panel;

said frame comprising a pair of spaced-apart surfaces, one of which comprises a foil mounting surface while the other comprises a sealing land surface disposed in a confronting relation to said face panel sealing land, said foil mounting surface of said frame having an overall external span which is less than the span of said face panel by at least the wall thickness of said one extremity of said funnel bell portion, said foil having its peripheral portion frit bonded to said frame foil mounting surface, indexing means associated with said frame sealing land and cooperable with said face panel registration affording means to permit precise registration between said frame mounted foil and said face panel and frit means for bonding said funnel, said frame and said face panel together with said foil wholly enclosed within said funnel bell portion and with said foil aperture pattern in registration with said pattern of elemental phosphor areas.

2. A color cathode ray tube as set forth in claim 1 in which said frame has a thickness dimension, as measured in a direction parallel to said funnel central axis, which is principally determinative of a desired Q-spacing.

3. A color cathode ray tube as set forth in claim 1 in which said color selection electrode assembly further comprises a stabilizing member having an overall peripheral span not greater that the peripheral span of said frame foil mounting surface, said stabilizing member further comprising at least one substantially flat surface disposed in a confronting relation to said foil mounting surface of said frame and adapted to be frit sealed to said foil mounting surface.

4. A color cathode ray tube as set forth in claim 1 in which said frame foil mounting surface and said foil are arranged to be wholly enclosed by said funnel bell portion.

5. A color cathode ray tube as set forth in claim 1 in which said frame is wholly enclosed within said funnel bell portion and in which said bell portion sealing land is disposed in a confronting relation to said face panel sealing land.

6. A color cathode ray tube as set forth in claim 1 in which said foil mounting surface comprises a sealing land adapted to receive said bell portion sealing land.

7. A color cathode ray tube as set forth in claim 1 in which said frame comprises a pedestal portion comprising a foil-mounting area and a sealing land area disposed in a parallel spaced-apart plane from said foil-mounting area and adapted to receive said bell portion sealing land.

8. A color cathode ray tube as set forth in claim 1 in which said face panel registration affording means are selectively located and oriented upon said face panel sealing land.

9. A color cathode ray tube as set forth in claim 1 in which said sealing land surface of said frame has an overall external span that essentially coincides with the overall external span of said face panel.

10. In a color cathode ray tube, the apparatus comprising:

a faceplate having a predetermined pattern of phosphor deposits on a target surface thereof;

a rear envelope section;

a color selection electrode assembly including an insulating frame supporting a foil having a pattern of apertures therein related to said predetermined pattern of phosphor deposits, said frame maintaining said foil in tension;

means for bonding said color selection electrode assembly between said faceplate and said rear envelope section with said pattern of foil apertures in registration with said pattern of phosphor deposits to incorporate said color selection electrode assembly as an integral part of said cathode ray tube envelope;

said foil being sized and said frame being adapted such that said foil is supported completely within the tube enclosure on a peripheral frame surface facing away from the said faceplate.

11. In a color cathode ray tube, the apparatus comprising:

a faceplate comprising a target surface having a pattern of luminescent primary color elemental phosphor deposits thereon and a sealing area circumscribing said target area, said faceplate having a plurality of registration-affording elements selectively located thereon;

a color selection electrode assembly affording selection of said phosphor deposits by a scanning beam of electrons, including an insulating frame to which is bonded a tensed foil having a pattern of color selection apertures related to said pattern of phosphor areas;

indexing means on said electrode assembly and cooperable with said registration-affording elements on said faceplate for establishing precise registration between said foil apertures and said elemental phosphor deposits on said target surface; and bonding means for uniting said faceplate and said electrode assembly with said indexing means and said alignment elements in registered relationship;

said foil being sized and said frame being adapted such that said foil is supported completely within the tube enclosure on a peripheral frame surface facing away from the said faceplate.

12. In a color cathode ray tube, the apparatus comprising:

a faceplate having a predetermined pattern of phosphor deposits on a target surface thereof;

a rear envelope section;

a color selection electrode comprising a two-part insulating frame supporting in tension a foil having a pattern of apertures therein related to said predetermined pattern of phosphor deposits, said frame having a first part with a peripheral section having sealing surfaces on opposite sides, and a second part which captures the foil in tension between itself and an inner section of said first part;

means for sealing said peripheral section of said first part of said frame between said faceplate and said rear envelope section with said pattern of foil apertures in registration with said pattern of phosphor deposits, said color selection electrode being incorporated as an integral part of said tube envelope.

* * * * *

Disclaimer 4,595,857.—*William A. Rowe,* Palatine and *Paul Strauss,* Chicago, Ill. TENSION MASK COLOR CATHODE RAY TUBE APPARATUS. Patent dated June 17, 1986. Disclaimer filed Nov. 24, 1986, by the assignee, *Zenith Electronics Corp.*

Hereby enters this disclaimer to claim 10 of said patent.

[*Official Gazette February 3, 1987.*]